United States Patent [19]

Bowers

[11] 4,353,946

[45] Oct. 12, 1982

[54] EROSION CONTROL MEANS

[75] Inventor: Geoffrey Bowers, "Mootawingee" Via Bowna, Australia

[73] Assignee: Seasonmakers Pty. (Australia) Lts, Beaconsfield, Australia

[21] Appl. No.: 243,338

[22] Filed: Mar. 13, 1981

[51] Int. Cl.[3] ..... B32B 5/12

[52] U.S. Cl. ..... 428/109; 405/15; 405/19; 428/138; 428/247; 428/255; 428/537

[58] Field of Search ..... 428/109, 110, 111, 113, 428/138, 247, 255, 369, 401, 537, 296, 283, 280, 281, 326, 362, 371, 233; 405/15, 19

[56] References Cited

U.S. PATENT DOCUMENTS

| | | | |
|---|---|---|---|
| 3,472,720 | 10/1969 | Harvey et al. | 428/280 |
| 3,765,997 | 10/1973 | Dunning | 428/296 |
| 3,928,696 | 12/1975 | Wandel et al. | 405/19 |
| 4,144,370 | 3/1979 | Boulton | 428/255 |
| 4,168,335 | 9/1979 | Vos et al. | 405/19 |
| 4,181,450 | 1/1980 | Rason et al. | 428/296 |
| 4,184,786 | 1/1980 | Richards | 428/255 |
| 4,219,600 | 8/1980 | Surowitz et al. | 428/247 |
| 4,232,067 | 11/1980 | Coleman | 428/113 |

*Primary Examiner*—James J. Bell

*Attorney, Agent, or Firm*—Michael J. Striker

[57] ABSTRACT

Method and means for producing an erosion control blanket formed from wood wool fibres retained in a coherent structure with a biodegradable mesh to be secured on a soil surface to ameliorate erosion of that surface and provide a basis for plant regrowth which will subsequently bind the soil surface.

2 Claims, 2 Drawing Figures

EROSION CONTROL MEANS

BACKGROUND OF THE INVENTION

The present invention relates to erosion control and in particular to means to be applied to a ground surface for preventing or reducing its erosion and to a method of manufacturing such means.

Methods of controlling erosion on steeply sloping ground have heretofore entailed such action as forming gutters running transverse to the slope, application of interlocking concrete and other slab arrangements. Other methods of erosion control include the use of jute sacking pegged to the soil and sprayed with bitumen; the use of bark and heavy wood chips covered with chicken wire. Such methods are effective in arresting soil erosion but prevent and inhibit the growth of plants, grass and flora.

SUMMARY OF THE INVENTION

The present invention aims to provide a means which alleviates erosion problems by supplying a biologically degradable barrier between the soil and the effects of wind and rain which enables regrowth to proceed in a stable meanner.

In one form the present invention provides an erosion control blanket comprising a mat of wood wool fibres retained in a coherent structure by means of a biodegradable mesh such that at least some of the fibres interlock with the mesh and others of said fibres.

Another form of the invention provides a method of forming an erosion control blanket comprising feeding shredded wood wool fibres onto a length of biodegradable mesh and kneading the wood wool against said mesh to secure it to same by interlocking at least some of said fibres with said mesh and others of said fibres.

The present invention will now be described by way of example with reference to the accompanying drawings:

DETAILED DESCRIPTION OF THE PREFERRED EMBODIMENTS

Figure 1:
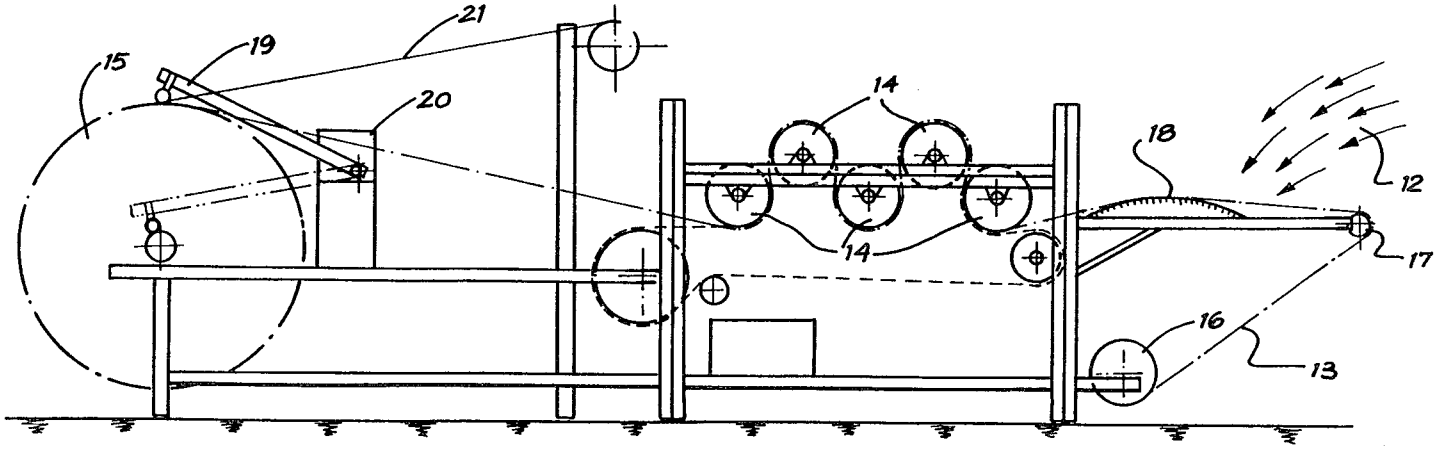
FIG. 1 is a schematic elevation of an arrangement for producing erosion control blanket in accordance with the present invention.
Figure 2:
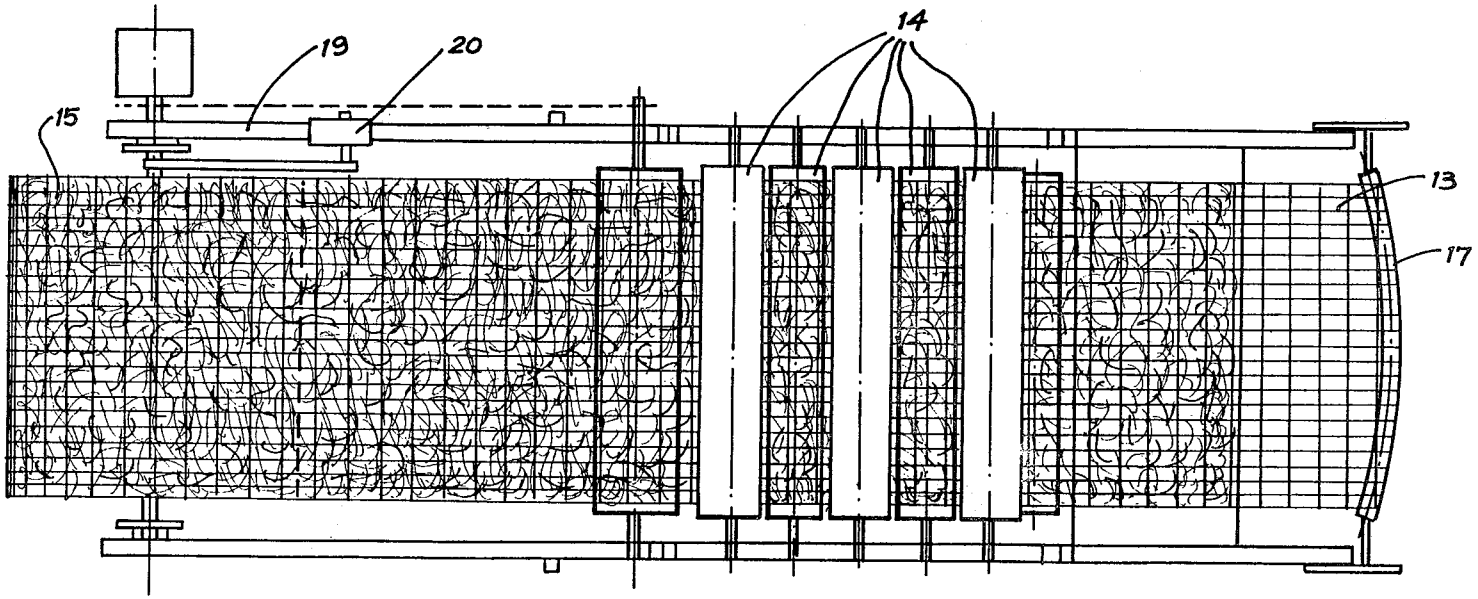
FIG. 2 is a plan view of the arrangement of FIG. 1.

In the drawings shredded wood wool 12 is supplied from shredding machine (not shown) and such wool is advantageously produced by a shredding machine comprising cutters in accordance with our earlier Australian Pat. No. 248,949.

The free flowing wood wool 12 is fed to the travelling surface of a biodegradable plastics mesh 13 which then passes across a series of kneading rollers 14. The rollers 14 compress the wool and by its contact with the mesh becomes interlocked therewith. The continuously formed product is wound onto a rool 15 and cut when a desired size of roll is achieved.

The mesh 13 is fed from a roll 16 across camber bar 17 whereafter the wood wool is deposited thereon. The wood wool 12 is assisted to be engaged in mesh 13 by being passed across fibre brushes 18 before entering the rollers 14. As the end product is wound on to roll 15 a plastics separation sheet 21 is roll fed between layers of the product. To ensure even winding of roll 15 there is provided in arm 19 coupled to a tension sensor 20 for controlling the tension imposed by the roll 15.

In use the erosion control material of this invention can function by being laid over a soil surface on which regrowth is desired. The surface may be first seeded and the blanket laid and secured at intervals over the surface, the mesh surface being uppermost. As rain falls or the blanket is watered the regrowth breaks through the upper surface of the blanket and eventually the blanket itself will be degraded to form a source of mulch for the new growth.

The blanket provides protection for the soil from wind and water erosion and a substantial amount of moisture will be trapped by the wood wool and provide a moisture store for the regrowth.

I claim:

1. A soil erosion control blanket, comprising a mat of wood-wool fibers retained in a coherent structure by means of a biodegradable mesh such that at least some of the fibres interlock with the mesh and others of said fibres.

2. An erosion control blanket as claimed in claim 1, wherein said mesh is of plastics material.

* * * * *